United States Patent [19]

Stout

[11] Patent Number: 4,657,089

[45] Date of Patent: Apr. 14, 1987

[54] METHOD AND APPARATUS FOR INITIATING SUBTERRANEAN WELL PERFORATING GUN FIRING FROM BOTTOM TO TOP

[75] Inventor: Gregg W. Stout, Montgomery, Tex.

[73] Assignee: Baker Oil Tools, Inc., Orange, Calif.

[21] Appl. No.: 743,580

[22] Filed: Jun. 11, 1985

[51] Int. Cl.[4] ..... E21B 43/116

[52] U.S. Cl. ..... 175/4.6; 102/318; 166/297

[58] Field of Search ..... 166/297; 175/4.55, 4.56, 175/4.6; 89/1.15; 102/312, 318, 322

[56] References Cited

U.S. PATENT DOCUMENTS

| | | | |
|---|---|---|---|
| 2,831,429 | 4/1958 | Moore | 89/1.15 |
| 2,935,020 | 5/1960 | Howard et al. | 175/4.6 |
| 2,968,243 | 1/1961 | Turechek | 175/4.6 |
| 3,128,702 | 4/1964 | Christopher | 175/4.6 |
| 3,245,485 | 4/1966 | Bell | 175/4.6 |
| 3,860,865 | 1/1975 | Stroud et al. | 89/1.15 X |
| 4,140,188 | 2/1979 | Vann | 175/4.51 |
| 4,292,895 | 10/1981 | Bell et al. | 102/318 X |
| 4,410,188 | 2/1984 | Vann . | |
| 4,481,884 | 11/1984 | Yunan | 102/312 X |
| 4,523,649 | 6/1985 | Stout | 175/4.6 |
| 4,543,703 | 10/1985 | Wetzel et al. | 175/4.6 X |
| 4,564,076 | 1/1986 | Vann et al. | 175/4.52 |

FOREIGN PATENT DOCUMENTS

| | | | |
|---|---|---|---|
| 258201 | 10/1970 | U.S.S.R. | 175/4.55 |

*Primary Examiner*—Stephen J. Novosad
*Assistant Examiner*—William P. Neuder
*Attorney, Agent, or Firm*—Norvell & Associates

[57] ABSTRACT

A method and apparatus for effecting the firing of a perforating gun having a plurality of vertically spaced, shaped charges wherein the firing is accomplished from the lowermost shaped charge to the uppermost shaped charge. In one modification, the detonation of the shaped charges is accomplished by a primer cord extending through all the gun sections, which is detonated only by a booster charge located in the bottom portion of the perforating gun housing. The booster charge is in fluid communication with the interior of the housing and, upon the occurrence of leakage of well fluids into the housing, the booster charge is rendered ineffective, thus preventing the firing of the perforating gun when the lower portion of the gun is filled with well fluids. In another modification, a conventional primer cord with booster charges on each end is inserted in each gun section, as is a length of flame-transmitting tubing. A flame is conveyed by such tubing from the top of the gun to the bottom to ignite a booster charge which causes the detonation of the primer cord in the bottom section, which detonation moves upwardly through all the gun sections.

29 Claims, 6 Drawing Figures

METHOD AND APPARATUS FOR INITIATING SUBTERRANEAN WELL PERFORATING GUN FIRING FROM BOTTOM TO TOP

CROSS-REFERENCE TO RELATED APPLICATION

This application is related in subject matter to: U.S. patent application Ser. No. 743,429, entitled "Perforating Gun for Initiation of Shooting from Bottom to Top"; U.S. patent application No. 743,579, entitled "Method and Apparatus for Firing Multisection Perforating Guns"; and U.S. application Ser. No. 743,578, entitled "Boosterless Perforating Gun and Method of Assembly".

BACKGROUND OF THE INVENTION

1. Field of the Invention

The invention relates to perforating guns employed for perforating the casing and adjoining production formation of a subterranean well, and to a method for operating said gun so that the vertically spaced charges disposed in the gun are fired from the bottommost charge upwardly to the uppermost charge.

2. History of the Prior Art

The utilization of a plurality of vertically and angularly spaced shaped charges to effect the perforation of a subterranean well represents the modern approach to achieving perforation of the well casing and the adjoining production formation. In recent years, it has become desirable to mount the shaped charges of the perforating gun within or upon a tubular housing, which in turn is run into the well on the bottom of a tubular string, which may comprise the production string. To provide additional protection of the shaped charges and the primer cord for actuating such shaped charges from the potential adverse effects of contact with well fluids, it is customary to effect a sealed connection of all components of the perforating gun housing containing the shaped charges in order that the interior of the housing is isolated from well fluids. As is well known to those skilled in the art, even though the most carefully assembled units may, after being run into the well, and particularly a well having substantial deviations from the true vertical, experience stresses which result in the creation of leakage paths for well fluids to enter the perforating gun housing. Multisection guns having an overall length on the order of 100 to 2,000 feet are particularly subject to inadvertent leakage. Since the shaped charges are normally sealed within a container, and the primer cord for activating such shaped charges is encased within a thermoplastic tube, the existence of well fluids within the perforating gun housing will not necessarily prevent the detonation of the primer cord and the subsequent detonation of the shaped charges. The presence of fluids within the housing during the detonation of the shaped charges results in a very substantial hydraulic expansion force being exerted on the wall of the perforating gun housing. In some instances, the expansion is sufficient to bulge the housing into tight engagement with the casing and thus effectively prevent the removal of the perforating gun from the well.

It follows that there is a definite need in the subterranean well industry for the method and apparatus for perforating the well casing and the adjoining production formation which will not fire the shaped charges when the lower portions of the perforating gun housing are partially filled with well fluids but, in the absence of any substantial amount of well fluids, will achieve the firing of all of the shaped charges mounted within the perforating gun housing.

SUMMARY OF THE INVENTION

The invention contemplates a method of firing the vertically spaced shaped charges disposed in a hollow housing of a perforating gun by detonating the primer cord by which the vertically spaced shaped charges of the gun are successively ignited from the bottom end of the gun upwardly, thus firing the lowermost shaped charge first and the uppermost shaped charge last. The detonation of the primer cord is accomplished by a booster charge which is disposed at the bottom of the housing containing the shaped charges. Such booster charge is disposed in a thin-walled container which is apertured at one or more areas to provide fluid communication with the interior of the perforating gun housing. It follows that if any significant quantities of well fluids leak into the perforating gun housing, such fluids will also leak into the booster charge container and effectively prevent the firing of the booster charge. If the booster charge is not fired, the primer cord is not detonated and no firing of the vertically spaced shaped charges can occur.

In accordance with one modification of the invention, a substantially continuous primer cord is inserted through all the gun sections and is connected at its bottom end to the bottom booster charge. The ignition of the booster charge disposed at the bottom of the perforating gun housing is accomplished by a fusible cord or detonation energy transmitting flexible tube which is inserted downwardly through the perforating gun in contiguous relationship to the primer cord. The deflagration or fusion rate of the fusible cord is sufficiently low as to be incapable of detonating either the primer cord or the shaped charges, but is sufficient to ignite the booster charge disposed at the bottom of the perforating gun housing, assuming that such housing has not been penetrated by well fluids. Thus, if the bottom booster charge is dry, the ignition of the fusible cord at a point above all of the shaped charges will effect the transmission of a detonating energy downwardly through the perforating gun housing to ignite the booster charge, which in turn detonates the bottom end of the primer cord, and such detonation then passes upwardly along the primer cord through the perforating gun housing and fires all of the vertically spaced shaped charges contained therein.

The aforedescribed modification does involve one problem in the case of excessively long guns, and that is the insertion of continuous length of primer cord and detonation transmitting tubing through all sections of the gun. This problem is avoided in accordance with a modification of this invention wherein each gun is provided with an individual length of primer cord and an individual length of detonation energy transmitting tubing. Each primer cord conventionally carries a booster charge at each of its top and bottom ends. A length of detonation energy transmitting tubing is individually mounted in each gun section in radially spaced, parallel relationship to the primer cord. The upper end of the detonation transmitting tubing is bent to define a circle lying in a radial plane. The lower end of the detonation transmitting conducting tubing is connected to a reduced-power booster charge, known as a DDT charge, which may be of the type sold by Ensign Bickford Company of Simsbury, Conn. under the trademark "PRIMADETS". Each of the primer cord booster charges is isolated from the DDT charges by a protective sleeve so that the DDT charge will not effect the discharge of the adjacent booster charges provided on the ends of the primer cords but will ignite the circular portion of the next lower detonation transmitting tubing. With this construction, when the upper end of the detonation transmitting tubing in the uppermost gun section is ignited, the detonation energy will be conducted by the detonation transmitting tubing downwardly through each of the successive gun sections until it reaches the bottom section. Here, the DDT charge is not surrounded by a protective shield and when it detonates, it effects the detonation of the lower booster charge provided in the bottom gun section. This detonation ignites the primer cord, and such detonation travels upwardly through each of the gun sections successively detonating the booster charges provided at the juncture of each successive gun section.

The primary advantage of this modification is that the detonation transmitting tubing may be assembled in the perforating gun section at the factory and the assemblage of the successive gun sections is accomplished in the same manner as heretofore employed for conventional perforating guns. Thus, no particular training of the operator is required in order to effect the successful operation of this modification of this invention to fire a multisection perforating gun from the bottom upwardly.

Further advantages of the invention will be readily apparent to those skilled in the art from the following detailed description, taken in conjunction with the annexed sheets of drawings, on which are shown several embodiments of the invention.

DESCRIPTION OF THE PREFERRED EMBODIMENTS

Figure 1A:
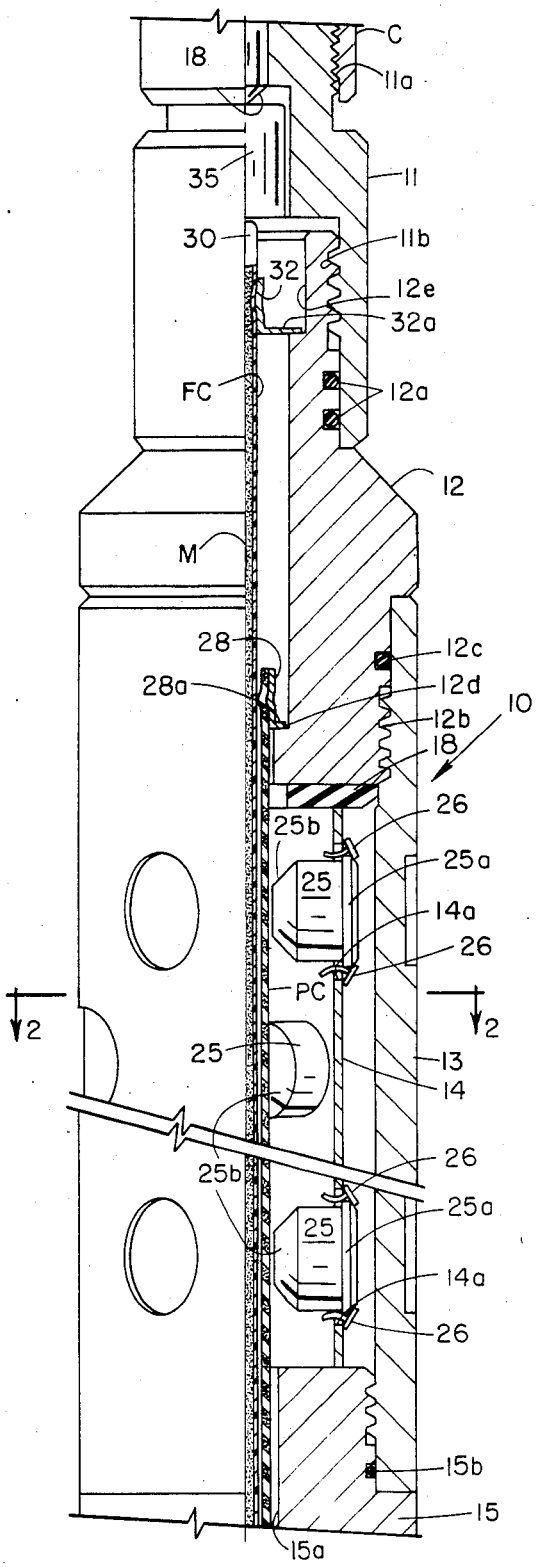
FIGS. 1A and 1B collectively represent a vertical sectional view of a multisection well perforating gun embodying this invention.
Figure 1B:
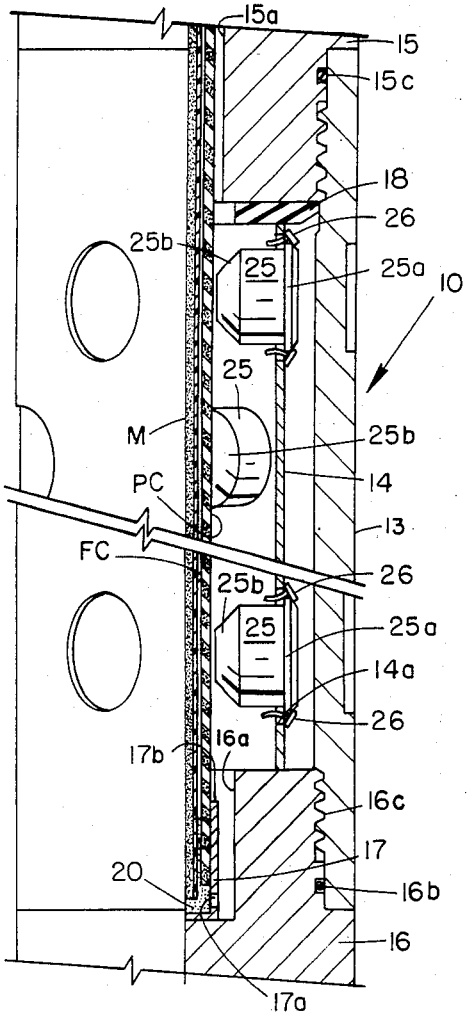
Figure 2:
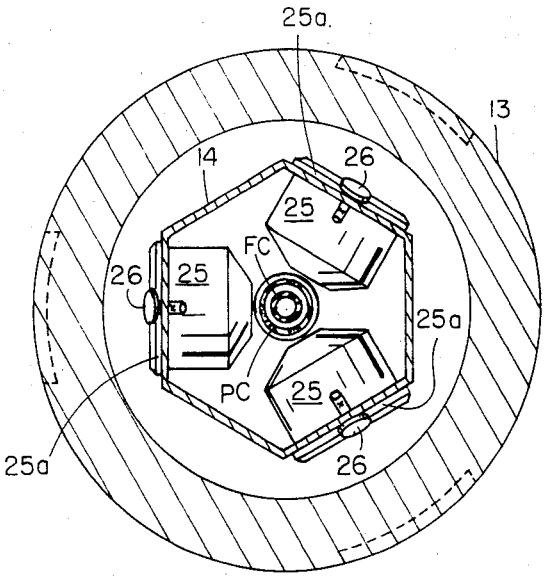
FIG. 2 is an enlarged scale, sectional view taken on the plane 2—2 of FIG. 1A.

Referring to FIGS. 1A and 1B, there is shown an assembled, multisection perforating gun 10. As is conventional, the perforating gun 10 terminates at its upper end in a firing head 11 which is threadably connected by external threads 11*a* to the lower end of a well conduit C. Internal threads 11*b* are provided at the lower end of firing head 11 for connection to a booster chamber sub 12. O-rings 12*a* sealably secure this threaded connection. Booster chamber sub 12 is in turn connected by external threads 12*b* to a cylindrical housing 13. O-ring 12*c* effects the sealing of this threaded connection.

The cylindrical housing 13 comprises one section of a multisection perforating gun. Each gun section is substantially identical, comprising the cylindrical housing 13 which is internally threaded at both its upper and lower ends for interconnection by externally threaded hollow nipples 15 and sealed by O-rings 15*b* and 15*c*. Nipples 15 are provided with central bores 15*a* through which any fluids entering the gun may drain to the bottom of the gun. Each housing section 13 is preferably limited in length to about 10 feet and, since perforating guns often require a total length in excess of one hundred feet, it is readily apparent that a large number of sections may be sealably interconnected in vertically stacked relationship.

The lowermost housing section 13 is provided at its bottom end with a solid plug 16 which has external threads 16*c* for engaging the internal threads in the lowermost housing section 13 and mounts O-ring 16*b* for sealing the threaded connection. Plug 16 defines an upwardly open chamber 16*a* within which a thin-walled container 17 containing a booster charge 20 is positioned. Container 17 is provided with one or more apertures 17*a* to provide fluid communication with the interior of the perforating gun housing. Hence, any well fluids inadvertently leaking into any of the housing sections 13 will collect in the plug chamber 16*a* and penetrate the booster charge 20 through the apertures 17*a*.

A plurality of vertically and angularly spaced, shaped charge containers 25 are mounted within each housing section 13. The specific manner of mounting such charges forms no part of this invention and they may be either sealably mounted in the walls of the housing sections 13 or, as illustrated in FIGS. 1A and 1B, may be mounted in vertically spaced apertures 14*a* provided in the walls of a polygonal tubular carrier 14 which is concentrically positioned within the interior of each tubular housing section 13. An elastomeric washer 18 is positioned between the top end of each carrier 14 and the bottom surface of nipple 15 or sub 12 in the case of the top gun section. Each shaped charge container 25 is provided with an enlarged flange 25*a* and this flange is held in the respective aperture in the carrier 14 by blind rivets 26 in the manner described in detail in co-pending application, Ser. No. 432,481, filed Oct. 4, 1982, and assigned to the Assignee of this application.

The inner ends 25*b* of each shaped charge container 25 are of conventional conical configuration and are disposed in substantially concentric relationship to the axis of the tubular housing 13. In accordance with one embodiment of the invention, a continuous primer cord PC, which is preferably formed in a tubular configuration, is then inserted either upwardly or downwardly between all of the inner ends of the shaped charge containers 25 and into contact with the booster charge 20 disposed at the bottom of the perforating gun. The uppr end 17*b* of the booster charge container 17 may be crimped to the bottom of primer cord PC and thus be inserted in chamber 16*a*. The tubular primer cord PC may be any one of several commonly utilized cords formed from cyclotrimethylene trinitramine material, such as the primer cord sold by Ensign Bickford Company of Simsbury, Conn. under the trademark "PRIMACORD". Such primer cord material is not readily ignitable, but when ignited, it detonates with a detonation rate in excess of 8,000 meters per second. The resultant heat and shock wave is more than sufficient to effect the detonation of all the shaped charge containers disposed along primer cord PC.

A method and apparatus for inserting the continuous primer cord PC through the various gun sections is disclosed in the above-mentioned co-pending application, Ser. No. 743,579, filed concurrently herewith now U.S. Pat. No. 4,598,776. While the primer cord PC is preferably continuous, those skilled in the art will recognize that sections of primary cord may be crimped together by conventional fasteners and, if desired, the primer cord may include booster charges connected at spaced intervals along its length. All of such modifications are deemed to be included in the term "continuous primer cord".

In all modifications of this invention, the primer cord PC is detonated by ignition of the booster charge 20 located in the bottom of the gun. Such ignition is preferably accomplished by a fusible cord or detonation energy transmitting tubing FC which is mounted within the bore of the primer cord PC and hence, is concurrently inserted into the perforating gun 10. The fusible cord FC preferably comprises a shock tube sold under the Trademark "NONEL" by the Ensign Bickford Company of Simsbury, Conn. The NONEL shock tube is a hollow plastic tube of about 3/16-inch diameter with a very small amount of reactive material M coating the inside wall, which propogates a flame or shock wave signal at a rate on the order of 6,000 feet per second. The NONEL shock tube is thus incapable of effecting the detonation of the primer cord PC, even though it is disposed in contiguous relationship thereto. It does transmit sufficient energy, however, to effect the ignition of the booster charge 20.

The primer cord PC extends upwardly from the booster charge 20 only so far as the uppermost shaped charge containers 25, where it may be supported by a crimped ferrule 28 having a radially projecting flange 28*a* engaging an upwardly facing shoulder 12*d* provided in the firing head 12. The NONEL shock tube, however, extends upwardly through the bore of the booster charge sub 12 where it is sealed by a conventional humidity seal 30 and supported by a crimped ferrule 32 having an outwardly projecting support flange 32*a* which rests upon the bottom surface of the booster chamber 12*e* provided in the top end of the booster chamber sub 12.

Booster charge 20 may be any one of several well-known charges, such as "DDT" charges which have the property of effecting the transition of a shock wave on the order of 6,000 feet per second to a sufficient detonation intensity to effect the detonation of the primer cord PC. Such DDT charges are sold by the Ensign Bickford Company under the trademark "PRIMADETS". However, and this is important, such booster charge is quite sensitive to the presence of moisture and if any significant amount of well fluids collect in the bottom of the chamber 16*a* within which the booster charge is located, it will be penetrated by such well fluids and rendered inoperative. It is therefore impossible to effect the ignition of the primer cord PC and the firing of the shaped charges in the presence of well fluids within the perforating gun 10. On the other hand, if no well fluids are present, the NONEL shock tube FC is ignited in conventional fashion by a primer charge 35 which may be electrically fired or, as shown in FIG. 1A, my be detonated by a firing pin 18 which is driven downwardly by fluid pressure or by a detonating bar (not shown) dropped from the surface of the well through the well conduit C.

Figure 3:
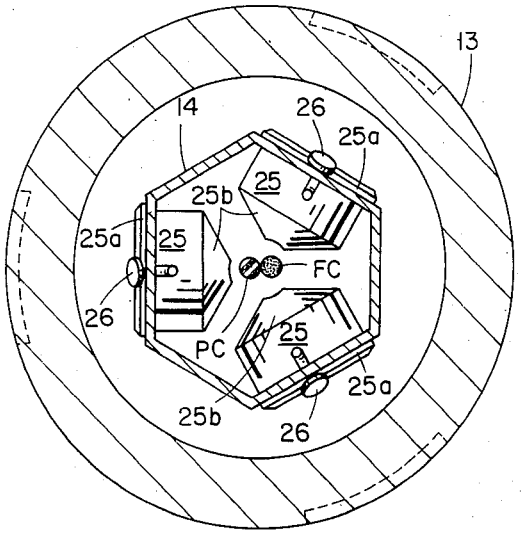
FIG. 3 is a view similar to FIG. 2 but representing an alternative embodiment of this invention.

Those skilled in the art will recognize that though perhaps not entirely commercially or otherwise practical, the relative position of the NONEL shock tube FC and the primer cord PC may be reversed or altered, i.e., the NONEL tube might comprise the outer element and receive a solid rod or tubular form of primer cord within its bore. Thus the term "cord" as employed in the claims may comprise either a solid or tubular cross-section. Similarly, as illustrated in FIG. 3, the NONEL shock tube FC and the primer cord PC may be contiguously united by fusion or adhesive or inserted side-by-side and fed concurrently down or pulled up through the interconnected sections of perforating gun 10.

Figure 4:
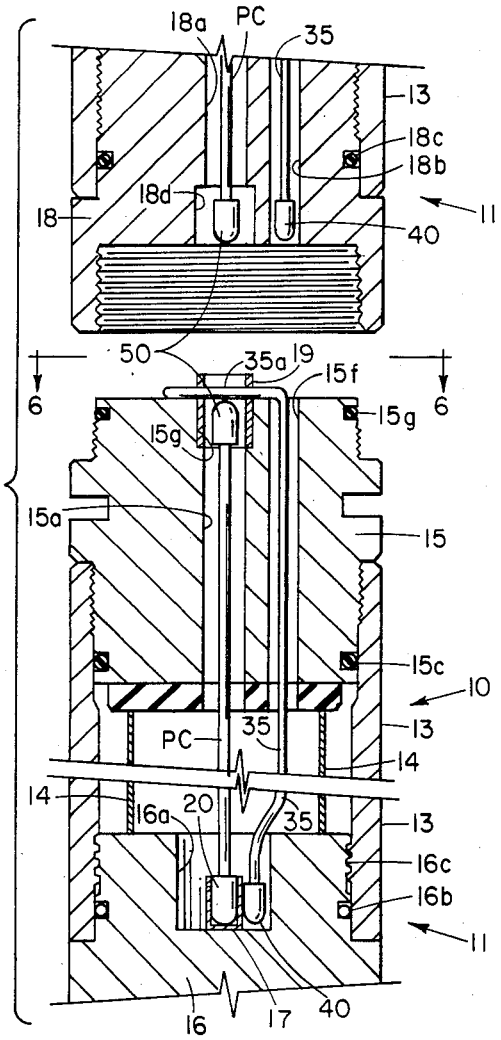
FIG. 4 represents a vertical, sectional view of a further modification, showing the bottom portion of one gun section, the top portion of the next lower gun section shown in spaced relationship prior to assemblage, and the bottom portion of the lowermost gun section.
Figure 5:
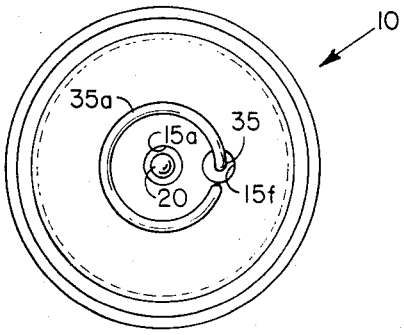
FIG. 5 is a sectional view taken on the plane 5—5 of FIG. 4.

Referring to FIGS. 4 and 5, there is shown further modification of this invention which eliminates the necessity of running either a continuous primer cord PC or detonation transmitting cord FC from the top of the gun to the bottom in order to effect firing from the bottom up. In FIG. 4 there is shown the bottom end of one gun section 11 disposed in preassembled spaced relationship to the top end of the next gun section 11. A connecting sub 18 provided at the bottom of each gun section and is provided with an axial passage 18*b* which is radially spaced with respect to the central bore 18*a* of the connecting sub 18. Similarly, the nipple 15, which is threaded into the connecting sub 18, is provided with an axial passage 15*f* radially spaced from the central bore 15*a* of each nipple by the same distance as the radial spacing of the passage 18*b*.

Passage 18*b* and 15*f* are utilized for mounting a length of NONEL shock tube 35, approaching the length of the gun section, in parallel relationship to a conventional axially mounted primer cord PC which is provided with conventional booster charges 50 at both its top and bottom ends. Counter bores 18*d* and 15*g* are respectively provided in connecting sub 18 and nipple 15 in the ends of axial passages 18*a* and 15*a* to receive a shielding sleeve 19 when the adjoining gun sections are assembled. The conventional booster charges 50 are thus effectively isolated from the flame-conducting tubing PC, except that no shielding sleeve is provided in the bottom gun section where the primer cord booster charge 20 is mounted in an apertured thin-walled container 17, as described above. The DDT charge 40 and container 17 are disposed in adjacent relationship in chamber 16*a* of plug 16. Because the radial passages 18*b* and 15*f* will never be exactly aligned in each threaded connection of the connecting sub 18 to a nipple 18, and top end of the NONEL shock tube 35 is formed in a circular configuration 35*a* lying in a radial plane, as best shown in FIG. 5. The length of NONEL shock tube 35 extends entirely through each perforating gun section 11 and terminates at its lower end in a crimped connection to a DDT charge 40.

The uppermost NONEL shock tube 35 is ignited by any conventional mechanism, such as an impact-actuated primer charge (not shown), and the flame generated within the NONEL shock tube 35 travels downwardly to the DDT charge 40 disposed at the bottom of the uppermost gun section. The firing of this DDT charge effects the ignition of the circular end 35*a* of the NONEL tube lying in the next lower gun section 13 and the flame progresses from one gun section to the other to the bottom of the gun where it ignites the primer cord booster charge 20 connected to the bottom end of the primer cord PC in the manner described above in connection with the other modifications of this invention. Of course, if the booster charge 20 located at the bottom of the gun has been contaminated with moisture, then it will not fire and the inadvertent firing of the entire gun section when fluids are present within the gun is avoided.

The modification of the invention illustrated in FIGS. 4 and 5 has the further advantage in that the assembly of gun sections, primer cords, and booster charges 40 proceed in the same manner as a conventional gun, thus eliminating the necessity of specially training the drilling rig operator. Additionally, the NONEL shock tube 35 may be preassembled in each of the gun sections and transported with the gun section to the drilling site. The primer cord PC, DDT booster charges 40, and the booster charges 50 will be assembled at the drilling site in each gun section in conventional fashion, but this represents an operation well-known to drilling rig operators.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A perforating gun for a subterranean well, comprising: an elongated tubular carrier insertable in the well and defining a chamber normally sealed from entry of well fluids; a plurality of shaped charge containers transversely mounted in said carrier chamber in vertically spaced relation, each said shaped charge container having a primer end and a discharge end; a firing mechanism including a primer charge disposed above said shaped charge containers; a booster charge disposed below said shaped charge containers in the bottom of said chamber to be rendered inoperable by well fluids entering said chamber; primer cord means for detonating said shaped charges extending upwardly from said booster charge to pass adjacent all primer ends of said shaped charge containers; and means responsive to detonation of said primer charge for detonating said bottom booster charge to ignite said primer cord means to successively fire said shaped charges from the bottom of the gun upwardly to the top.

2. The perforating gun of claim 1 wherein said means for detonating said booster charge comprises a firing mechanism disposed above said shaped charges; and a tubing containing a detonation transmitting material extending downwardly from said firing mechanism to said booster charge.

3. The perforating gun of claim 2 wherein said tubing contains a fusible powder.

4. The perforating gun of claim 1 wherein said firing mechanism is located in the top of the perforating gun, and said tubing containing a detonating transmitting material is contiguous to said primer cord.

5. The perforating gun of claim 4 wherein said primer cord extends through the bore of said tube; the energy generated by said detonation transmitting material being inadequate to ignite said primer cord.

6. The perforating gun of claim 4 wherein said primer cord is formed in a tubular configuration and surrounds said tube; the energy generated by said detonation transmitting material being inadequate to ignite said primer cord.

7. The perforating gun of claim 1 wherein said elongated carrier comprises a plurality of axially stacked tubular sections, each section mounting a plurality of said shaped charge containers; and wherein said primer cord means comprises a primer cord axially traversing each gun section and having a booster charge at its top and bottom ends; said primer cord booster charges of one gun section being respectively axially adjacent the lower primer cord booster charge of the upwardly adjacent gun section; and the upper booster charge of the lowerly adjacent gun section.

8. The perforating gun of claim 7 wherein said means for detonating said bottom booster charge comprises a length of detonation energy transmitting tubing extending through each said section in parallel relationship to the axis thereof; a charge mounted on the bottom end of each said length to ignite the top end of said length of detonation energy transmitting tubing in the next lower section; and means for shielding said primer cord booster charges from the detonation of the adjacent one of said charges, except the lowermost primer booster charge, whereby detonation energy is transferred successively downwardly through said gun sections to detonate said bottom booster charge.

9. The perforating gun of claim 8 wherein said shielding means comprises a sleeve enclosing the gap between each pair of axially adjacent primer cord boosters.

10. The perforating gun for a subterranean well, comprising: an elongated carrier insertible in the well; a plurality of shaped charge containers transversely mounted in said carrier in vertically spaced relation, each said shaped charge container having a primer end and a discharge end; a firing mechanism including a primer charge disposed above said shaped charge containers; and a plural-component primer means extending between said primer charge and booster charge and disposed adjacent the primer ends of said shaped charge containers; said plural-component primer means including elongated adjacent elements respectively formed from low energy and high energy detonatable materials; said low energy material being ignitable by said primer charge and said high energy material being ignitable only by said booster charge; the detonation energy of said low energy material being inadequate to ignite said high energy material or to fire said shaped charges, and the detonation of the high energy material being adequate to fire said shaped charges; whereby actuation of said firing mechanism results in sequential firing of the shaped charges from the lowermost one upwardly to the uppermost one.

11. The perforating gun of claim 10 wherein said high energy material comprises a tubular element and said low energy material is disposed within a thermoplastic tube inserted in the bore of said tubular element.

12. The perforating gun of claim 10 wherein said low energy material comprises a particulate deposit on the bore surface of a thermoplastic tube, and said high energy material comprises a rod formation inserted in said bore of the thermoplastic tube.

13. A perforating gun for subterranean well, comprising: an elongated carrier insertable in the well; a plurality of shaped charge containers transversely mounted on said carrier in vertically spaced relation, each said shaped charge container having a primer end and a discharge end; a firing mechanism including a primer charge disposed above said shaped charge containers; a booster charge disposed below said shaped charge containers; a detonation energy transmitting cord extending between said primer charge and said booster charge, and a detonatable primer cord extending from said booster charge upwardly adjacent the primer end of each said shaped charge container.

14. The perforating gun of claim 13 wherein said primer cord is contiguous to said detonation energy transmitting cord, the detonation energy of said detonation transmitting cord being inadequate to detonate said primer cord.

15. The perforating gun of claim 13 wherein one of said detonating energy transmitting cord and said primer cord is tubular and telescopically encompasses the other cord.

16. The perforating gun of claim 13 wherein said detonating energy transmitting cord comprises an elongated body coated with explosive powder.

17. The perforating gun of claim 15 wherein said primer cord is contiguous to said detonation transmitting cord; the detonation energy of said detonation transmitting cord being inadequate to detonate said primer cord.

18. A perforating gun comprising: a plurality of substantially identical, axially stacked tubular sections; each said section mounting a plurality of shaped charge containers in vertically and angularly spaced relation; said containers having detonating ends disposed concentrically about the section axis; a primer cord extending axially through each section; a booster charge on the top and bottom ends of each primer cord, whereby the bottom booster charge of each primer cord is axially adjacent to the top booster charge of the primer cord in the next lower section; a length of detonation transmitting tubing extending through each said second in parallel relationship to the axis thereof; a charge mounted on the bottom end of each said length to ignite the top end of said length in the next lower section; and means for shielding said primer cord booster charges from the detonation of the adjacent one of said charges; except the lowermost primer booster charge, whereby detonation energy is transferred successively downwardly through said gun sections to said charge in the bottom of the lowermost section, thereby detonating said lowermost primer booster charge.

19. The perforating gun of claim 18 wherein said shielding means comprises a sleeve enclosing the gap between each pair of axially adjacent primer cord boosters.

20. The perforating gun of claim 18 wherein said lowermost gun section has an axial well at the bottom to collect fluids leaking into said sections; said bottom primer booster charge being disposed in said axial well and being pervious to fluids, thereby preventing firing of the perforating gun when fluids are present in said axial well.

21. The method of detonating a plurality of vertically spaced shaped charges of a perforating gun for a subterranean well, comprising the steps of:

(1) at the well surface connecting a booster charge below all of the shaped charged and a firing mechanism above all of the shaped charges;

(2) connecting a detonation transmitting cord between the firing mechanism and the booster charge, said cord, when detonated, being incapable of detonating the shaped charges but capable of detonating the booster charge;

(3) running a primer cord in close proximity to each of said shaped charges and into contact with said booster charge; said primer cord being detonatable by said booster charge and having sufficient energy to successively fire each of said shaped charges; and (4) lowering the perforating gun into the well to the desired location and actuating said firing mechanism, whereby said shaped charges are successively fired from the lowermost one upwardly.

22. The method of claim 21 wherein after connecting the booster charge below the shaped charges, the perforating gun is lowered into the well sufficiently to dispose all shaped charges below the surface.

23. The method of claim 21 wherein said detonation transmitting cord and said primer cord are contiguous and concurrently inserted into the perforating gun.

24. The method of claim 21 wherein said primer cord and detonation transmitting cord are telescopically assembled and are concurrently inserted into the perforating gun.

25. The method of claim 21 further comprising the step of disposing the booster charge in a bottom recess in the perforating gun where fluids leaking into the gun can collect to render said booster charge inoperative.

26. The method of detonating a plurality of vertically spaced shaped charges of a perforating gun for a subterranean well, comprising the steps of:

(1) at the well top surface connecting a booster charge below all of the shaped charges and a firing mechanism above all of the shaped charges;

(2) running a primer cord in close proximity to each of said shaped charges and into contact with said booster charge; said primer cord being detonatable by said booster charge and having sufficient energy to successively fire each of said shaped charges;

(3) positioning said gun at a location within said well; and (4) conveying a detonation energy downwardly from the firing mechanism to said booster charge to detonate same, thereby detonating the bottom of said primer cord and successively firing said shaped charges from the lowermost one upwardly.

27. The method of detonating a plurality of vertically spaced shaped charges disposed in a plurality of axially stacked sections of a perforating gun for a subterranean well, comprising the steps of:

(1) prior to assembling each gun section, axially mounting a primer cord in the gun section with a booster charge secured to the top and bottom ends of the primer cord;

(2) prior to assembly of the gun section, disposing a length of a detonation transmitting cord in parallel relationship to the primer cord in each gun section and securing a charge to the lower end of the detonation transmitting cord;

(3) assembling the successive gun sections and enclosing the gap between the axially adjacent booster charges on the top and bottom ends of the primer cords in a protective shield;

(4) lowering the assembled gun sections in the well; and (5) detonating the top end of the detonation transmitting cord in the uppermost gun section, whereby detonating energy is transmitting downwardly successively by the detonation transmitting cord length to detonate the charge and thereby detonate the lowermost booster charge to successively detonate the primer cords from the lowermost one upwardly through all the gun sections.

28. The method of claim 27 further comprising the step of forming the upper end of each length of detonation transmitting cord to define a circular configuration disposed in a radial plane, whereby the detonation of the charge at any angular location will effect the ignition of the next lower length of detonation transmitting cord.

29. The method of detonating a plurality of vertically spaced shaped charges of an individual perforating gun for a subterranean well comprising the step of successively firing the shaped charges beginning with the lowermost shaped charge and progressing continuously upwardly to the uppermost shaped charge.

* * * * *